US006367433B2

(12) United States Patent
Oyama et al.

(10) Patent No.: US 6,367,433 B2
(45) Date of Patent: Apr. 9, 2002

(54) ELECTROMAGNETIC ACTUATOR AND VALVE-OPEN-CLOSE MECHANISM

(75) Inventors: Hitoshi Oyama; Takao Nishioka; Kenji Matsunuma; Hisanori Ohara, all of Itami (JP)

(73) Assignee: Itami Works of Sumitomo Electric Industries, Ltd., Hyogo (JP)

( * ) Notice: Subject to any disclaimer, the term of this patent is extended or adjusted under 35 U.S.C. 154(b) by 0 days.

(21) Appl. No.: 09/731,027

(22) Filed: Dec. 7, 2000

(30) Foreign Application Priority Data

Dec. 9, 1999 (JP) ..... 11-349868
Jun. 20, 2000 (JP) ..... 2000-184885
Oct. 20, 2000 (JP) ..... 2000-320722

(51) Int. Cl.[7] ..... F01L 9/04

(52) U.S. Cl. ..... 123/90.11; 251/129.01; 251/129.1; 251/129.16; 335/220; 335/266

(58) Field of Search ..... 123/90.11; 251/129.01, 251/129.1, 129.15, 129.16; 335/220, 266, 268

(56) References Cited

U.S. PATENT DOCUMENTS 3,732,893 A * 5/1973 Ziesche et al. ..... 137/625.65
4,291,860 A * 9/1981 Bauer ..... 251/129.02
4,518,938 A * 5/1985 Bartholomaus et al. ..... 335/262
4,826,130 A * 5/1989 Griffith et al. ..... 251/129.15
5,791,630 A * 8/1998 Nakao et al. ..... 251/129.19
6,039,014 A * 3/2000 Hoppie ..... 123/90.11
6,206,343 B1 * 3/2001 Kato et al. ..... 251/129.15

FOREIGN PATENT DOCUMENTS

JP 11-93629 4/1999

* cited by examiner

*Primary Examiner*—Weilun Lo
(74) *Attorney, Agent, or Firm*—McDermott, Will & Emery

(57) ABSTRACT

A valve-open-close mechanism is proposed which has parts designed to reduce friction during sliding. The electromagnetic actuator comprises a pair of electromagnets each having a stator and a coil opposed to each other with a gap therebetween, an armature disposed in the gap, and a first stem for transmitting to external the movement of said armature. A retainer and a first return spring are provided on the valve. A second stem is provided at other side of the armature and another retainer and a second return spring are provided for the second stem. A coating film is formed on at least one of the surface or end face of the stem portion of the valve, end faces of the first return spring or second return spring, spring bearing end faces of the retainers, surface or end face of the second stem, and the surface of the armature.

5 Claims, 3 Drawing Sheets

ELECTROMAGNETIC ACTUATOR AND VALVE-OPEN-CLOSE MECHANISM

BACKGROUND OF THE INVENTION

The present invention relates to an electromagnetic actuator and a valve-open-close mechanism used mainly in an automotive internal combustion engine.

Conventional valve-open-close mechanism actuated by electromagnetic actuators are disclosed e.g. in Japanese patent publication 11-93629. Explaining with reference to FIG. 1, which shows one embodiment of this invention, an electromagnetic actuator 4 includes a pair of electromagnets 6, 7 each made up of a stator 5 and a coil 18 that are opposed to each other with a gap S therebetween. An armature 3 is disposed in the gap S so as to be reciprocable between two electrotromagnets 6, 7. A first stem 15 for transmitting the movement of the armature 3 from one electromagnet 6 toward the other electromagnet 7 to a valve 9 for an internal combustion engine is provided on one side of the armature 3, namely, at the side where there is the electromagnet 7.

Also, the electromagnetic actuator 4 is housed in a housing 8 fixed to an internal combustion engine body 19; the tip of the first stem 15 of the electromagnetic actuator is brought into abutment with the tip of the valve 9 so that when the armature 3 is moved from the electromagnet 6 toward the electromagnet 7, the first stem 15 opens the valve 9 by pushing it; in order to impart a biasing force to the valve for a valve-closing operation, a retainer 13 is provided on the valve 9, and a first return spring 2 is mounted between the retainer 13 and the internal combustion engine body 19; a second stem 14 is provided on the armature 3 on the side opposite to the side coupled to the first stem 15; and a retainer 13' is provided on the second stem 14, and a second return spring 1 for imparting a biasing force in the direction in which the second stem 14 pushes the armature 3 is mounted between the retainer 13' and the housing 8.

In this valve-open-close mechanism, the weights of the directly driven parts during actuation have a direct influence on the driving power consumption of the electromagnetic actuator 4 as an inertia weight. Such parts slide during actuation and the friction during sliding motion of the parts has a direct influence on the power consumption. Since the driving power is normally supplied from the on-board battery, an increase in the power consumption is not preferable.

To reduce the power consumption, not only the lessening of weights of the parts but reduction of the sliding friction are necessary.

An object of this invention is to reduce the sliding friction of the parts forming the valve-open- close mechanism.

SUMMARY OF THE INVENTION

According to the present invention, there is provided an electromagnetic actuator comprising a pair of electromagnets each made up of a stator and a coil, a movable element comprising an armature and a first stem for transmitting the force that acts on the armature to an external load, characterized in that a coating film is formed on a surface or an end face of the first stem.

A valve-open-close mechanism can be formed by use of such an electromagnetic actuator.

According to this invention, by forming the coating film, it is possible to reduce the sliding friction, reduce the driving power consumption for the electromagnetic actuator and reduce the fuel consumption if it is used in an automobile.

According to the present invention, the electromagnetic actuator comprises a pair of electromagnets each made up of a stator and a coil opposed to each other with a gap therebetween; an armature disposed in the gap so as to be reciprocable between the pair of electromagnets by driving the electromagnets; and a first stem for transmitting to external the movement of the armature from one electromagnet toward the other electromagnet, the first stem being provided at a moving side of the armature; the electromagnetic actuator being housed in a housing fixedly mounted to an internal combustion engine body; the armature being moved from the one electromagnet toward the other electromagnet, so that the first stem opens the valve by pushing the valve; the electromagnetic actuator further comprising a first retainer provided on the valve for imparting a biasing force to the valve for a valve-closing operation, and a first return spring mounted between the first retainer and the internal combustion engine body; a second stem provided at a surface of the armature on the side not coupled to the first stem; and a second retainer provided on the second stem, and a second return spring mounted between the second retainer and the housing for imparting a biasing force to urge the armature, a coating film being formed on at least one of the front face or end face of the stem portion of the valve, end faces of the first return spring or second return spring, spring bearing end faces of the retainers, surface or end face of the second stem, and the surface of the armature.

DETAILED DESCRIPTION OF THE PREFERRED EMBODIMENT

Figure 1:
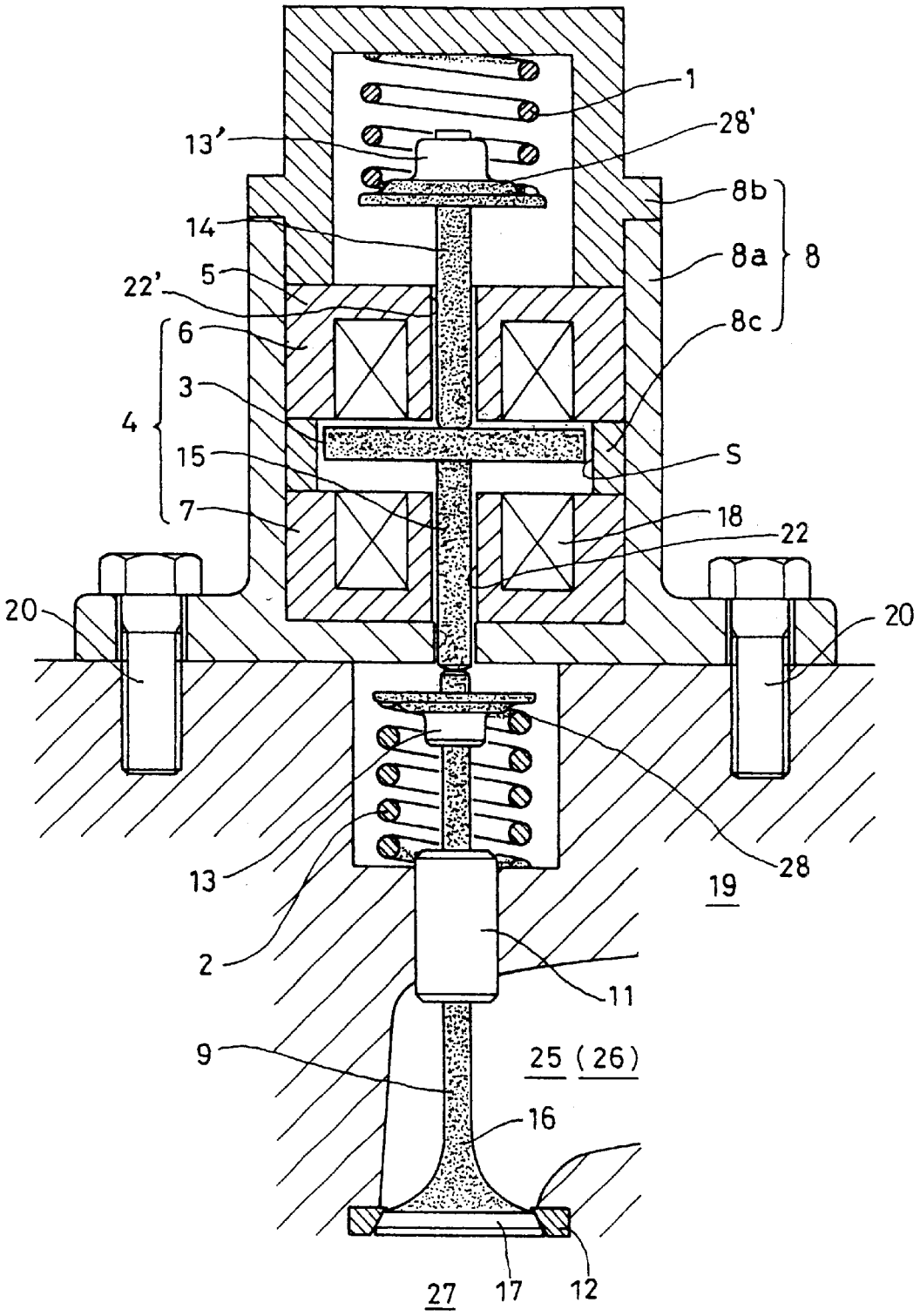
FIG. 1 is a sectional view of a valve open-close mechanism embodying the present invention.

The electromagnetic actuator 4 for an internal combustion engine according to this invention has, as shown in FIG. 1, a pair of electromagnets 6, 7, and movable elements including an armature 3 and a first stem 15.

The armature 3 is mainly made from a magnetic material. The electromagnets 6, 7 are each made up of a stator 5 and a coil 18. By passing a current through the coils 18, a magnetic field is produced. The pair of electromagnets 6, 7 are provided opposite to each other with a gap S therebetween. The armature 3 is disposed in this gap S. Thus, the armature 3 is reciprocable between the two electromagnets 6, 7 by the magnetic field produced by the electromagnets 6, 7. If the armature is joined or mechanically fastened to the first stem 15 or the second stem 14, by the first stem 15, or the second stem 14 or if an inter-electromagnet housing 8*c* is provided very close to the outer peripheral surface of the armature 3, using the inter-electromagnet housing 8*c* as a guide, the armature 3 can be smoothly reciprocated between two electromagnets 6, 7.

Also, the armature 3 sometimes contacts the electromagnet 6 or 7 while rotating. On the surface of the armature 3, as shown by clot pattern of FIG. 1, it is preferable to provide a coating film such as a ceramics coating film, carbon-family coating film or a composite-material coating film. This makes it possible to reduce the friction coefficient upon contact with the electromagnet 6 or 7.

As the coating film, a ceramic coating film, a diamond-like carbon film (hereinafter abbreviated to "DLC film"), a diamond film, a carbon nitride film or a composite-material film of a nitride, carbide, carbo-nitride, oxy-nitride, oxy-carbide, carbo-oxy-nitride or sulfide of a metal in the IVa, Va, VIa groups of the periodic table or aluminum (Al), boron (B), silicon (Si) may be used. In the composite-material film, powder particles of a metallic compound as a fixed lubricant are dispersed in a polymer.

It is necessary that the metallic compound used for the composite-material film have properties as a solid lubricant. Specifically, at least one of $MOS_2$, BN, $CaF_2$, $Cr_2O_3$, $MoO_3$ and $B_2O_3$ is preferable.

Also, it is necessary that the polymer used in the composite-material film serve as a binder for retaining powder particles of the intermetallic compound. Specifically, at least one of polyamide-imide, polyimide, polytetrafluoroethylene, polyphenylene sulfide and diarylphthalate resin is preferable. But if a polymer other than the above is used, the composite-material film containing intermetallic compound powder particles can become soft and the wear resistance reduces. Thus, care is needed for the selection of the polymer.

As the structure of the coating film, a coating film using one kind of material among the above materials, a mixed film using two or more kinds of them, and a laminated film comprising a coating film using one material and the mixed films.

In order to transmit the movement of the armature 3 from one electromagnet 6 toward the other electromagnet 7, the first stem 15 is inserted in a guide hole 22 provided in the stator 5 of the electromagnet 7. By the first stem 15, the movement of the armature 3 from the side of the electromagnet 6 toward the side of the electromagnet 7 acts on the valve 9, which is in abutment with the tip of first stem 15, thereby opening the valve of the internal combustion engine.

As the material forming the first stem 15, it may be an iron-family material. But to achieve reduction in weight, it may be made of a ceramic material whose major component is silicon nitride or SIALON, an aluminum alloy sintered material formed by molding an aluminum alloy powder by powder molding and then sintering it (hereinafter referred to as "aluminum alloy hardened material"), or a titanium alloy.

As for the ceramic material, to ensure reliability against breakage, use of a sintered material containing 80 wt % or more of silicon nitride or SIALON and having a relative density of 95 wt % or over is preferable.

Further, the ceramic material includes a fiber-reinforced ceramics and a whisker-reinforced ceramics.

The powder molding method is a method in which a rapid-cooled-solidified powder is formed from a molten metal of an aluminum alloy having a predetermined composition by high-pressure gas blowing, it is compressed, heated at about 500° C., and hot-forged to give them shapes for densification and to make it into a part. The thus obtained aluminum alloy hardened material having a predetermined shape is formed of fine aluminum-based crystal particles of about 100–1000 nm and strengthened by fine deposition of hard composite intermetallic compound of aluminum and other element metals on the base. The degree of densification is preferably 95% or over. Further, as the aluminum alloy hardened material, it is necessary that it be a high-temperature sliding member having heat-resistant strength in a sliding state.

The first stem 15 and the below-described second stem 14 may be formed of the same material or different materials.

Further, on the surface and end faces of the first stem 15, as shown by dot pattern of FIG. 1, it is preferable to provide a coating film such as a ceramic coating film, carbon-family coating film or a composite-material coating film. By providing such a coating film on the surface of the first stem 15, it is possible to reduce the dynamic friction coefficient and seizure on the sliding surface when the first stem 15 is driven in the guide hole 22 of the stator 5, and thus reduce the energy loss due to sliding. By providing such coating film on the end faces of the first stem 15, it is possible to reduce the friction coefficient produced when it contacts the armature 3 or the end face of the stem portion 16 of the valve 9 while rotating and to reduce the energy loss.

As the coating film, a ceramic coating film, a diamond-like carbon film (hereinafter abbreviated to "DLC film"), a diamond film, a carbon nitride film or a composite-material film of a nitride, carbide, carbo-nitride, oxy-nitride, oxy-carbide, carbo-oxy-nitride or sulfide of a metal in the IVa, Va, VIa groups of the periodic table or aluminum (Al), boron (B), silicon (Si) may be used. In the composite-material film, powder particles of a metallic compound as a fixed lubricant are dispersed in a polymer.

It is necessary that the intermetallic compound used for the composite film have properties as a solid lubricant. Specifically, at least one kind of $MoS_2$, BN, $CaF_2$, $Cr_2O_3$, $MoO_3$ and $B_2O_3$ is preferable.

Also, it is necessary that the polymer used in the composite film serve as a binder for retaining powder particles of the intermetallic compound. Specifically, at least one kind of polyamicle-imide, polyimide, polytetrafluoroethylene, polyphenylene sulfide and diarylphthalate resin is preferable. But according to the kind of polymer other than the above, there is a case in which the composite film containing intermetallic compound powder particles becomes soft and the wear resistance reduces. Thus, care is needed for the selection of this polymer.

As the structure oE the coating film, a coating ilm using one kind of material among the above materials, a mixed film using two or more kinds of them, and a laminated film comprising a coating film using one material and the mixed films. The provision of the coating film eliminates the need of forced supply of lubricating oil to the sliding surface where the first stem is driven through the guide hole 22 formed in the stator 5, thereby avoiding failure of the electromagnetic actuator.

The armature may be, if necessary, joined to or mechanically fastened to one or both of the first stem 15 and the second stem 14. With this arrangement, it is possible to guide the reciprocating motion of the armature 3 between the electromagnets 6 and 7.

As the first stem 15 or second stem 14 to be joined to or mechanically fastened to the armature 3, if a stem using a material smaller in specific weight than the armature is selected, it is possible to achieve a lighter weight than if the stem as an integral driving member is formed using a material as the same kind as the armature 3.

As a method of coupling the armature 3 and first stem 15 by joining or mechanical coupling, slidably coupling them together, bonding them together, or mechanically coupling them together can be cited. To ensure reliability of detaching and attaching, a joint means using a retainer in which a recessed groove is formed in the circumferential direction of the stem and the armature 3 is sandwiched there. Here, as a lighter material than the armature 3, ceramic material whose major component is silicon nitride or SIALON, an aluminum sintered material by powder molding, and a titanium alloy can be cited.

The stators 5 may be manufactured by machining an iron-family material, but may be manufactured by molding an iron-family powder by powder molding. Specifically, it may be manufactured by molding an iron-family powder by cold die press molding, warm die press molding or injection molding.

Figure 5A:
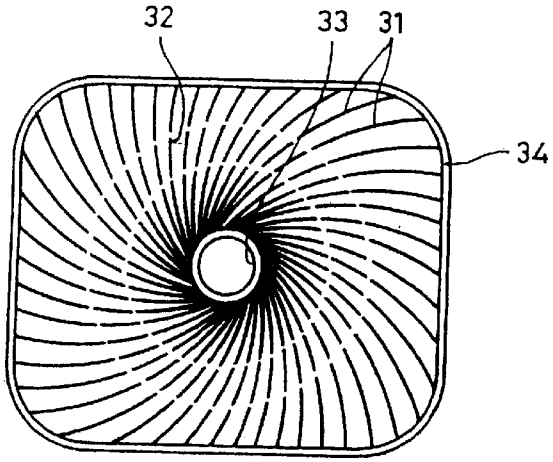
FIG. 5A PRIOR ART
FIG. 5A is a plan view of a conventional stator.
Figure 5B:
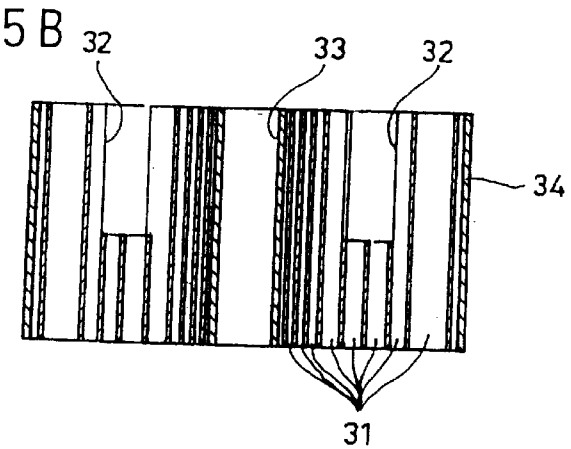
FIG. 5B PRIOR ART
FIG. 5B is a sectional front view of the same.

In contrast, with a conventional electromagnet, as shown in FIG. 5, since a coil is wound around a stator 34 formed with a recess 32 to house an electromagnetic copper plate 31 or a guide hole 33 is formed by machining, it is large in volume as an electromagnet, and machining such as cutting is necessary.

Figure 4A:
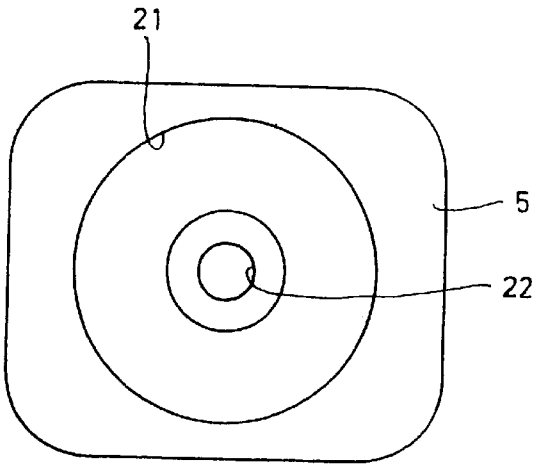
FIG. 4A is a plan view of a stator embodying this invention.
Figure 4B:
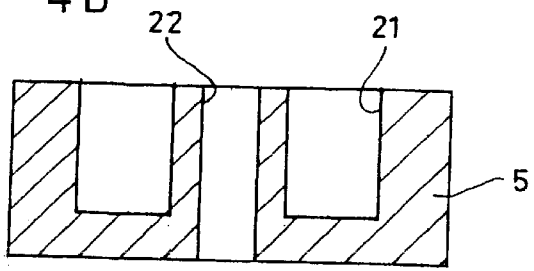
FIG. 4B is a sectional front view of the stator of FIG. 4A.

Thus, by employing by powder molding, as shown in FIG. 4, the recess 21 and the guide hole 22 can be formed with good accuracy, so that machining after molding can be omitted. Also, the stator can be more compact than conventional. Also, since it is possible to mount a pre-made coil in the recess, the number of manufacturing steps is fewer and mass-productivity is high.

In order to increase the density of the molded member obtained, obtain the same flux density as conventional electromagnets, and mold more compact stators 5, warm pressing or injection molding is advantageous.

The iron-family powder used for powder molding may be an ordinary iron-family powder, but an iron-family powder having an iron oxide film or a resin coated film is preferable. If powder molding is carried out using such an iron-family powder, as a constituent component of stators obtained, part or whole of the iron oxide film or coated resin film remains. Thus, formation of eddy current, which tends to be produced in a solid metal, is suppressed, so that stators with low iron loss are obtained. The iron oxide film is a film formed by oxidising the surface of an iron-family powder. The resin coated film is a film formed on the surface of an iron-family powder by applying, immersing or depositing a thermoplastic or thermosetting resin.

Thus, with the electromagnets using such stators, due to the effect of reduction in volume, reduction in volume of the parts including the below-described housing is achieved, so that it is possible to reduce their weights.

Heretofore, when the stems were passed through the guide holes 33 of the stators 34, it was necessary to mount slide bearings. In contrast, if the above stators are used, since surface smoothness and dimensional accuracy of the molded members are assured, no slide bearings are necessary, so that it is possible to insert the first stem 15 and the second stem 14 into the guide holes 22, 22'. This leads to reduction of the number of parts, which in turn results in reduction in weight and improved mass-productivity.

The coils 18 may be formed from an iron-family material. But it is preferable to form them from aluminum or a material containing aluminum as its major component. With this arrangement, a reduction in weight of the coils 18 is achieved. As the coils, a 1000-family or 6000-family aluminum alloy specified in JIS H 4000 may be used. As a coating material of the coils 18, heat resistance of 180° C. or over is required. It may be an esterimide, a polyimide or a polyamide-imide.

Next, the valve-open-close mechanism for an internal combustion engine according to this invention comprises an electromagnetic actuator 4, a housing 8, a valve 9 for opening and closing the suction or exhaust port, and a second stem 14.

The electromagnetic actuator 4 is housed in a housing 8, which is fixed to an internal combustion engine body 19 by fixing members 20.

The housing 8 comprises, as shown in FIG. 1, a housing 8*a* covering the outer peripheral surfaces of the electromagnets 6 and 7, a housing 8*b* covering the top ends of the electromagnets 6, 7, and an inter-electromagnet housing 8*c* for keeping the gap between the two electromagnets 6, 7. But as the housing, it is not limited to a structure formed of these three members but may be formed of any desired members according to the assembling conditions of the valve-open-close mechanism for an internal combustion engine according to this invention.

The material forming the housing 8 may be an iron-family material, but an impregnated composite material in which a metallic material is impregnated into an aggregate comprising a metallic porous member is preferable. By using such a material, a housing high in strength is obtained. Also, reduction in the wall thickness of the housing and making it compact are possible. Thus, it is possible to lessen the weight.

The metallic porous member may be manufactured by subjecting a foamed resin to a conductive treatment with graphite or the like, electroplating it, and subjecting it to heat treatment to remove the foamed resin, or by impregnating a foamed resin with metal/resin slurry, drying and subjecting it to heat treatment to remove the foamed resin.

As the metallic porous member, a high-strength alloy material containing Fe, Cr, Ni, etc. is preferable. Its volume rate is, though it depends on the required strength and weight, preferably within the range of 3–20%.

As the metallic material to be impregnated into the aggregate comprising the metallic porous member, one or two or more selected from a material containing aluminum as its major component such as an aluminum metal, an aluminum alloy or the like,, a material whose major component is a magnesium such as a magnesium metal or a magnesium alloy or the like, and foamed aluminum may be used.

As a method of impregnating an aggregate comprising a metallic porous member with a metallic material, a die-cast method, a high-pressure forging method such as molten metal forging, or an impregnation-forging method at a low pressure of several MPa or under can be used. This is because the cell hole diameter of the metallic porous member is of a relatively large size of 0.1 mm to 1 mm and it has an open-cell structure in which all cells communicate with one another.

The foamed aluminum is a foamed-state aluminum or aluminum alloy obtained by melting aluminum or an aluminum alloy such as an aluminum-calcium alloy, and adding a foaming agent such as titanium hydride or zirconium hydride to it to cause foaming by decomposition of the foaming agent.

With the thus obtained impregnated composite material, if an aluminum-family material or a magnesium-family material is used as the metallic material, it is possible to reduce the weight as a whole and thus the weight of the housing 8 itself.

As the fixing members 20, bolts are usually used as shown in FIG. 1. As the material for the fixing members 20, an iron-family material can be used. But it is preferable to use a material whose major component is an aluminum such as aluminum metal or an aluminum alloy.

By using a material whose major component is aluminum as the fixing members 20, reduction in the weight is achieved. Also this is preferable because the internal combustion engine body 19 for mounting the housing 8, such as an engine head, is made from an aluminum-family material, so that it is possible to suppress stress due to a difference in the thermal expansion coefficient when a change in temperature occurs during assembling or operation. As specific examples of the material forming the fixing members 20, materials specified under JIS H 4000 are preferable. In view of tensile strength, 4000-, 5000-, 6000- and 7000-family materials (under JIS H 4000) are preferable.

For the internal combustion engine body 19, a valve 9 for communicating an intake port 25 and an exhaust port 26 with a combustion chamber 27 and shutting them off is provided.

The valve 9 is formed from a marginal portion 17 forming a valve and a stem portion 16 forming a shaft. The material forming the valve 9 may be an iron-family material but may be such a material that the marginal portion 17 has heat resistance. A ceramic material whose major component is silicon nitride or SIALON may be used for both the stem portion 16 and marginal portion 17. For example, an aluminum alloy hardened material may be used as the stem portion 16 and a heat-resistant steel alloy as the marginal portion 17. By using these materials, it is possible to maintain heat resistance of the marginal portion 17 forming the valve and contribute to the reduction in weight.

As the heat-resistant steel alloy, JIS SUH 3 (Fe-11 wt %, Cr-2 wt %, Si-1 wt %, Mo- 0.6 wt %, Mn-0.4 wt %, C) or the like can be cited as an example.

As the silicon nitride, to ensure reliability against breakage, use of a sintered member containing 80 wt % or more of silicon nitride or SIALON and having a relative density of 95 wt % or over is preferable.

The ceramics include fiber-reinforced ceramics and whisker-reinforced ceramics.

Since the aluminum alloy hardened material has heat resistance in a sliding condition, it is preferable that it has an alloy structure in which in fine aluminum-based crystal particles, a similarly fine intermetallic compound deposits to strengthen the heat resistance and also that it is a dense material. As such an example, a material containing Al-17 wt %, Si-1.5 wt %, Zr-1.5%, Ni-2%, Fe-5%, Mm can be cited. Here, "Mm" is misch metal, namely, a composite metal formed mainly of rare earth elements such as lanthanum, cerium.

If such an aluminum alloy hardened material is used as the stem portion 16 and a heat-resistant steel alloy is used as the marginal portion 17, they can be joined together by hot pressing.

By making the stem portion 16 and the marginal portion 17 from different materials and joining them together, it is possible to form most part of the valve from an aluminum alloy and thus lessen the weight, and to selectively strengthen the portion that will be exposed to burning and heated to high temperature.

Figure 3:
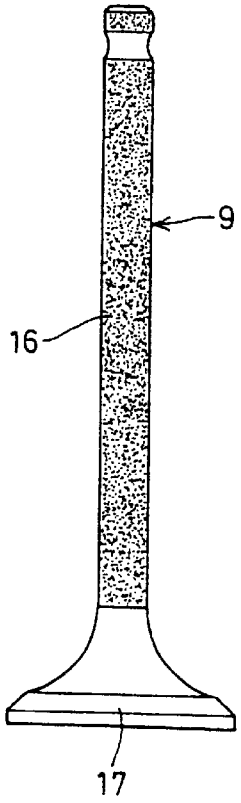
FIG. 3 is a front view of a valve.

Further, on the valve 9, particularly the surface and end faces of the first stem 15, as shown by dot pattern of FIGS. 1 and 3, it is possible to provide a coating film such as a ceramic coating film, carbon-family coating film or a composite-material coating film. By providing such a coating film on the surface of the valve 9, particularly on the surface of the stem portion 16, it is possible to reduce the dynamic friction coefficient and seizure on the sliding surface when the valve 9 is driven and thus reduce the energy loss; due to sliding. By providing such coating films on the end faces of the stem portion 16 of the valve 9, it is possible to reduce friction coefficient produced when it rotates and contacts the end face of the first stem 15 and to reduce the energy loss.

As the material forming the coating film, a ceramic coating film, a diamond-like carbon film (hereinafter abbreviated to "DLC film"), a diamond film or a carbon nitride film of a nitride, carbide, oxy-carbide or carbo-oxy-nitride of a metal in the IVa, Va, VIAa groups of the periodic table or aluminum (Al), boron (B), silicon (Si), or a composite film in which powder particles of an intermetallic compound as a fixed lubricant is dispersed in a polymer can be cited.

It is necessary that the intermetallic compound used for the composite film have properties as a solid lubricant. Specifically, at least one kind of $MoS_2$, BN, $CaF_2$, $Cr_2O_3$, $MoO_3$ and $B_2O_3$ is preferable.

Also, it is necessary that the polymer used in the composite film serve as a binder for retaining powder particles of the intermetallic compound. Specifically, at least one kind of polyamide-imide, polyimide, polytetrafluoroethylene, polyphenylene sulfide and diarylphthalate resin is preferable. But according to the kind of polymer other than the above, there is a case in which the composite film containing intermetallic compound powder particles becomes soft and the wear resistance reduces. Thus, care is needed for the selection of this polymer.

As the structure of the coating film, a coating film using one kind of material among the above materials, a mixed film using two or more kinds of them, and a laminated film comprising a coating film using one material and the mixed films. The provision of the coating film eliminates the need of forced supply of lubricating oil to the sliding surface where the stem portion 16 slides on the valve guide 11, thereby avoiding any failure of the electromagnetic actuator.

The valve 9 is provided such that by moving the armature 3 from the electromagnet 6 toward the electromagnet 7, the tip of the first stem 15 of the electromagnetic actuator 4 abuts the tip of the stem portion 16 of the valve 9 so that the valve opens.

In order to impart a biasing force for valve-closing operation to the valve 9, a retainer 13 is provided on the stem portion 16 of the valve 9 and a first return spring 2 is mounted between the retainer 13 and the internal combustion engine body 19.

Further, a valve guide 11 for guiding the valve-opening and closing motion is provided on the internal combustion engine body 19.

Specifically, the marginal portion 17 of the valve 9 is provided at the boundary between the intake port 25 or exhaust port 26 and. the combustion chamber 27, and at the boundary, a valve seat 12 is mounted. The valve 9 is closed by the first. return spring 2 and the intake port 25 and exhaust port 26 are shut off from the combustion chamber 27. When the first stem 15 pushes the stem portion 16 of the valve 9 by the movement of the armature 3, the marginal portion 17 is pushed into the combustion chamber 27, so that the intake port 25 or exhaust port 26 and the combustion chamber 27 communicate with each other. Thereafter, by the biasing force imparted by the first return spring 2, the marginal portion 17 is again pressed against the valve seat 12, so that this line is shut off. Here, the valve seat 12 is a member for seating the marginal portion 17. This prevents the marginal portion 17 from directly colliding against the internal combustion engine body 19.

Also, the first return spring 2 is housed in a recess formed in the internal combustion engine body 19, and the valve guide 11 is provided so as to guide the stem portion 16 of the valve 9, which extends through the portion between the recess and the intake port 25 or exhaust port 26.

As for the material forming the retainers 13, 13', it may be an iron-family material. But for the purpose of reducing the inertia weight for improving the quick open-close properties of the valve 9 and reducing the total weight of the internal combustion engine, the abovementioned aluminum alloy hardened material is preferable. This is because high fatigue characteristics are required because they are subjected to repeated stresses from the compression springs. Thus it is necessary to adopt an alloy design in which fine crystal particles on a submicron order are formed and a quick-cool-solidifying process. By using this, it is possible to lessen the weights of the retainers 13, 13' themselves.

As the aluminum alloy hardened material, the one used for the valve 9, first stem 15, second stem 14, etc. may be used. But since sliding occurs against the first return spring 2 and second return spring 1 during high-speed valve operation, an aluminum alloy is sometimes insufficient. In such a case, by using the above aluminum alloy powder containing 10 wt % of hard particles having an average diameter of about 1–5 $\mu$m and a maximum diameter of about 15 $\mu$m, it is possible to suppress wear. As the hard particles, nitride ceramic, oxide ceramic, carbide ceramic are preferable. As examples, silicone nitride, alumina, and silicon carbide can be cited.

Further, on the portion where the retainers 13, 13' contact the first return spring 2 or second return spring 1, i.e. on the spring-bearing end faces 28, 28' of the retainers 13, 13', as shown by dot pattern of FIG. 1, it is preferable to provide a coating film such as a ceramic coating film, carbon-family coating film or a composite-material coating film. By providing such a coating film on the spring-bearing end faces 28, 28' of the retainers 13, 13', it is possible to reduce the dynamic friction coefficient and seizure on the sliding surface when the retainers 13, 13' slide on the first return spring 2 and second return spring 1 and thus reduce the energy loss due to sliding.

As the material forming the coating film, a ceramic coating film, a diamond-like carbon film (hereinafter abbreviated to "DLC film"), a diamond film or a carbon nitride film of at nitride, carbide, oxy-carbide or carbo-oxy-nitride of a metal in the IVa, Va, VIAa groups of the periodic table or aluminum (Al), boron (B), silicon (Si), or a composite film in which powder particles of an intermetallic compound as a fixed lubricant is dispersed in a polymer can be cited.

It is necessary that the intermetallic compound used for the composite film have properties as a solid lubricant. Specifically, at least one kind of $MoS_2$, BN, $CaF_2$, $Cr_2O_3$, $MoO_3$ and $B_2O_3$ is preferable.

Also, it is necessary that the polymer used in the composite film serve as a binder for retaining powder particles of the intermetallic compound. Specifically, at least one of polyamide-imide, polyimide, polytetrafluoroethylene, polyphenylene sulfide and diarylphthalate resin is preferable. But according to the kind of polymer other than the above, the composite film containing intermetallic compound powder particles may become soft and the wear resistance reduce. Thus, care is needed for the selection of this polymer.

As the structure of the coating film, a coating ilm using one kind of material among the above materials, a mixed film using two or more kinds of them, and a laminated film comprising a coating film using one material and the mixed films.

The second stem 14 is provided at a surface opposite the surface of the armature 3 provided with the first stem 15. On the second stem 14, a retainer 13' is provided. Between the retainer 13' and the housing 8, the second return spring 1 for imparting a biasing force in the direction in which the second stem 14 pushes the armature 3 is provided.

The second return spring 1 opposes the biasing force of the first return spring 2, which acts on the armature 3 to prevent the armature from being pressed toward the other electromagnet 6 by the biasing force of the first return spring 2.

As the material forming the second stem 14, it may be an iron-family material. But to achieve reduction in weight, it is possible to use a ceramic material whose major component is silicon nitride or SIALON, aluminum alloy hardened material, titanium alloy, etc.

As the silicon nitride, to ensure reliability against breakage, use of a siatered material containing 80 wt % or more of silicon nitride or SIALON and having a relative density of 95 wt % or over is preferable.

Further, the ceramic material includes a fiber-reinforced ceramics and a whisker-reinforced ceramics.

As the aluminum alloy hardened material, it is required that it is a high-temperature slide member having a heat resistance in a sliding condition, the abovesaid aluminum alloy hardened material may be used.

The first stem 15 and the second stem 14 may be formed of the same material or different materials.

Further, on the surface and end faces of the second stem 14, as shown by dot pattern of FIG. 1, it is preferable to provide a coating film such as a ceramic coating film, carbon-family coating film or a composite-material coating film. By providing such a coating film on the surface of the second stem 14, it is possible to reduce the dynamic friction coefficient and seizure on the sliding surface when the second stem 14 is driven in the guide hole 22' of the stator 5 and thus reduce the energy loss due to sliding. By providing such coating films on the end faces of the second stem 14, it is possible to reduce friction coefficient produced when the it rotates and contacts the armature 3 or the end face of the stem portion 16 of the valve and to reduce the energy loss.

As the coating film, a ceramic coating film, a diamond-like carbon film (hereinafter abbreviated to "DLC film"), a diamond film, a carbon nitride film or a composite-material film of a nitride, carbide, carbo-nitride, oxy-nitride, oxy-carbide, carbo-oxy-nitride or sulfide of a metal in the IVa, Va, VIa groups of the periodic table or aluminum (Al), boron (B), silicon (Si) may be used. In the composite-material film, powder particles of a metallic compound as a fixed lubricant are dispersed in a polymer.

It is necessary that the intermetallic compound used for the composite-material film have properties as a solid lubricant. Specifically, at least one of $MOS_2$, BN, $CaF_2$, $Cr_2O_3$, $MoO_3$ and $B_2O_3$ is preferable.

Also, it is necessary that the polymer used in the composite-material film serve as a binder for retaining powder particles of the intermetallic compound. Specifically, at least one of polyamide-imide, polyimide, polytetrafluoroethylene, polyphenylene sulfide and diarylphthalate resin is preferable. But if a polymer other than the above is used, the composite-material film containing intermetallic compound powder particles can become soft and the wear resistance reduces. Thus, care is needed for the selection of the polymer.

As the structure of the coating film, a coating film using one kind of material among the above materials, a mixed film using two or more kinds of them, and a laminated film comprising a coating film using one material and the mixed films. The provision of the coating film eliminates the need of forced supply of lubricating oil to the sliding surface where the second stem is driven through the guide hole 22' formed in the stator 5, thereby avoiding failure of the electromagnetic actuator.

The material forming the first return spring 2 or the second return spring 1 may be an iron-family material. But by using the following material, namely, an alloy steel containing C: 0.55–0.70 wt %, Si: 1.0–2.2 wt %, Cr: 1 wt % or under, Mn: 1 wt % or under, V: 0.2 wt % or under, and if necessary, Mo and Nb, having a tensile strength of 1960 $N/mm^2$ or over, the particle diameter of inclusions such as $SiO_2$ and $Al_2O_3$ being 25 $\mu$m or under, and having a tempered martensitic structure, it is possible to obtain desired spring characteristics and lessen the spring weight. In the case of such a high-strength steel, after melt casting and hot pressing, it is worked to an intended wire diameter by combining shaving, wire drawing and patenting, and then hardening and tempering to obtain a steel wire. Thereafter, coiling, strain-removing annealing, shot peening, and if necessary, nitriding, shot peening and strain-removing annealing are usually carried out.

Further, as the material of the first return spring 2 or second return spring 1, if a titanium alloy comprising a total of 13 wt % of Al and V, having a tensile strength of 1500 $N/mm^2$ and having a surface coating that is good in wear resistance is used, it is possible to obtain desired spring characteristics and lessen the spring weight. The high-strength titanium alloy is melted in a vacuum, melt-forged repeatedly until component segregation decreases sufficiently, hot-pressed, then solution treatment and wire drawing repeatedly. After it has been worked to an intended wire diameter, it is subjected to ageing treatment. The steps after coiling are basically the same as mentioned above.

Furthermore, as the material of the first return spring 2 or second return spring 1, if an aluminum alloy containing a total of 5 wt % or more of Cu, Mg and Zn, having long crystal particles having an aspect ratio of the crystal particle diameter of 3 or over, and a tensile strength of 600 $N/mm^2$ or over, it is possible to obtain desired spring characteristics and lessen the spring weight. The high-strength aluminum alloy is formed into a powder of an intended composition, the powder is solidified into an ingot, and subjected to either or both of forging and pressing, wire drawing and solution treatment repeatedly to an intended wire diameter, and finally, ageing treatment. The steps after coiling are basically the same as with high-strength steel but no nitriding is done.

Also, in order to use the abovementioned titanium alloy and aluminum alloy for the first return spring 2 or second return spring 1, a coating film may be provided to improve the wear resistance of the surface, if necessary.

Further, on one or both of the end faces of the second return spring 1 or first return spring 2 where it contacts the retainers 13, 13', housing 8*b*, internal combustion engine, etc., it is preferable to provide a coating film such as a ceramic coating film, carbon-family coating film or a composite-material coating film. By providing such a coating film on one or both of the second return spring 1 or first return spring 2, it is possible to reduce the dynamic friction coefficient and seizure on the sliding surface when the second return spring 1 or first return spring 2 contacts the retainers 13, 13', housing 8*b*, internal combustion engine, etc. and to reduce the energy loss due to sliding.

As the coating film, a ceramic coating film, a diamond-like carbon film (hereinafter abbreviated to "DLC film"), a diamond film, a carbon nitride film or a composite-material film of a nitride, carbide, carbo-nitride, oxy-nitride, oxy-carbide, carbo-oxy-nitride or sulfide of a metal in the IVa, Va, VIa groups of the periodic table or aluminum (Al), boron (B), silicon (Si) may be used. In the composite-material film, powder particles of a metallic compound as a fixed lubricant are dispersed in a polymer.

It is necessary that the intermetallic compound used for the composite-material film have properties as a solid lubricant. Specifically, at least one of $MoS_2$, BN, $CaF_2$, $Cr_2O_3$, $MoO_3$ and $B_2O_3$ is preferable.

Also, it is necessary that the polymer used in the composite film serve as a binder for retaining powder particles of the intermetallic compound. Specifically, at least one kind of polyamide-imide, polyimide, polytetrafluoroethylene, polyphenylene sulfide and diarylphthalate resin is preferable. But according to the kind of polymer other than the above, there is a case in which the composite film containing intermetallic compound powder particles becomes soft and the wear resistance reduces. Thus, care is needed for the selection of this polymer.

As the structure of the coating film, a coating film using one kind of material among the above materials, a mixed film using two or more kinds of them, and a laminated film comprising a coating film using one material and the mixed films.

Figure 2:
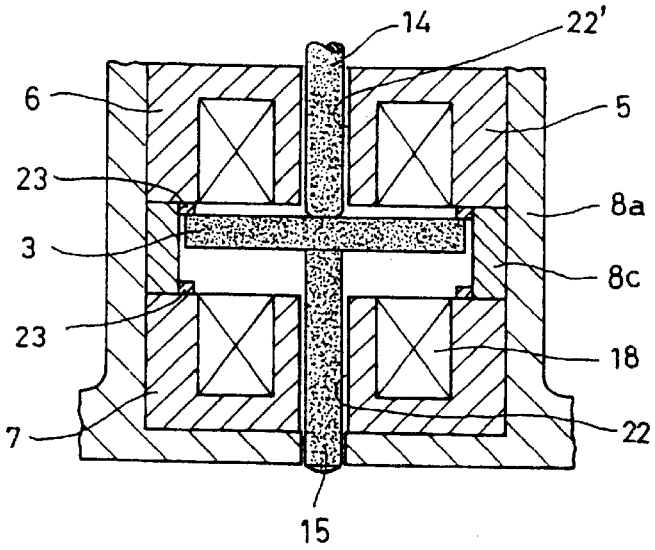
FIG. 2 is an enlarged sectional view of a portion of another embodiment.

In this invention, if the stator 5 is formed by molding an iron-family powder by powder molding, during operation of the valve-open-close mechanism, if the armature 3 and the stator 5 contact directly each other, it is liable to wear or chipping. Thus, it is preferable to reciprocate the armature 3 so as not to directly contact the stator 5. For this purpose, the reciprocating motion of the armature 3 may be controlled by an electric circuit, or stoppers 23 may be provided between the stator 5 and the armature 3 as shown in FIG. 2.

Also, the valve-open-close mechanism can be used either for an exhaust line or an intake line. If a heat-resistant steel alloy is used for the marginal portion 17 of the valve 9, it is preferable to use it in an intake line. If silicon nitride or a SIALON-family ceramic material is used for the marginal portion 17 of the valve 9, it is preferable to use it for an exhaust line.

It is not necessary to manufacture all of the first stem 15, second stem 14, housing 8, valve 9, first return spring 2, second return spring 1, retainers 13 and fixing members 20 of the above-described metal or its alloy, which is smaller in specific weight than iron, an alloy or a ceramic or a fiber- or whisker-reinforced ceramic reinforced with an aggregate which is smaller in specific weight than iron. Even if at least one of them is formed of such a material, and the others are formed of an iron-family material, it is possible to achieve lessening the weight of an electromagnetic actuator for an internal combustion engine or a valve-open-close mechanism for an internal combustion engine obtained.

EXAMPLE 1

Each part forming the valve-open-close mechanism shown in FIG. 1 was manufactured using the following materials. A coating film was formed on one of the surface or end face of the stem portion 16 of the valve 9, the end faces of the first return spring 2 or second return spring 1, the end faces 28, 28' of the retainers 13, 13', the surface or end face of the first stem 15, the surface or end face of the second stem 14, or the surface of the armature 3 in the following mannor. Using these parts, a valve-open-close mechanism was formed. Next, by actuating the valve-open-close mechanism, to what extent the consumed power decreased during driving compared with the case in which coating films were not provided at all was measured. The results are shown in Table 1.

Formation of coating film

A method of forming a DLC film on the surface (or end face) of the part to be processed is described below.

After the part had been cleaned with a solvent or a detergent and dried, it was mounted to an electrode to which was connected a high-frequency power source (generating frequency: 13.56 MHz) and gas was discharged with a vacuum degree of $1\times10^{-4}$ Pa, argon gas was introduced so that it was maintained at a pressure of $1\times10^{-1}$ Pa by capacitive coupling type plasma CVD method. In this state, a high frequency having the output of 400 W was supplied to the electrode from a high-frequency power source and it was maintained for 15 minutes so that the electrode mounted to the intended part was covered with a plasma. Then after removing a natural oxide film on the surface of the intended part by ion cleaning, by stopping the supply of argon gas and introducing methane gas until it was maintained at a pressure of $1\times10^{-1}$ Pa and supplying a high frequency having the output of 600 W to the electrode from the high-frequency power source, forming of a DLC film was carried out. The film thickness was about 1 $\mu$m.

[Manufacturing the Parts]

(Armature)

As the armature 3, an existing magnetic steel material was used. The below-described first stem 15 was fitted, pressed and joined.

(Stator)

The stator 5 of a shape shown in FIG. 4 was manufactured from a powder compressed molded body. Iron powder used was pure iron powder. It was manufactured by steps of preparing a powder solidified by quenching by blowing high-pressure water against molten metal, drying, and adjusting powder particle diameter distribution by passing through a mesh of a predetermined size. These steps are the same as in manufacturing an ordinary starting raw material powder for sintered machine parts. Thereafter, in order to assure insulation between pure iron powders, an oxide film forming step was carried out by heat treatment.

Main impurities before the formation of an oxide film were about 0.1 wt % of oxygen, about 0.05 wt % of Si and Mn, and about 0.005 wt % of carbon, phosphorus and sulfur. The powder particle diameter was controlled in the quench-solidifying step and the particle diameter distribution adjustment step for smooth and uniform flow filling into a mold, and so that as high an apparent density as possible was obtained. The particle diameter distribution thus obtained was such that 5–10 wt % of particles having a diameter of less than 200 $\mu$m and 150 $\mu$m or over, 40–50 wt % of particles of less than 150 $\mu$m and 75 $\mu$m or over, and 40–50 wt % of particles of less than 75 $\mu$m and 30 $\mu$m or over. According to the flow property evaluation under JSPMI standard, which is an index of flow filling properties, for the powder having such a particle diameter distribution, the time taken for 50 grams of powder housed in a funnel container having an outlet diameter of 2.5 mm to pass the outlet was 20–30 seconds. Also, the apparent density under the standard was 2.9–3.5 g/cm$^3$.

In order to manufacture the stator by molding this powder, the powder was charged into a mold, and in order to prevent seizure between the mold and the iron powder in uniaxially compressing, 0.5–0.7 wt % of organic resin containing a thermosetting resin as its major component was blended.

The powder compressed molded body obtained by cold-compression-molding the powder was 7.1 g/cm$^3$ in density. For a powder compressed molded material obtained by warm compression molding, the density was 7.4 g/cm$^3$. In warm compression molding, the mold and the powder to be compressed were controlled to a temperature of 130° C. to 150° C. The reason why the density was high in this case was mainly because the yield stress of the iron powder decreased and the deformability increased due to softening, so that the consolidation property increased.

These molded members were calcined at 200° C. in the atmosphere to obtain stators.

Generally, in an alternating magnetic field, the higher the frequency, the more an eddy current is produced and the more loss of magnetic force occurs. But with an aggregate of such a powder, production of eddy current is suppressed in the powder units, so that it is possible to reduce the loss. With this stator, due to its structural feature, there is little anisotropy in permeability. Dimensional variations after molding and calcining were small, so that no additional working was necessary. Thus, there was no need to set a bearing for passing the stem.

The maximum flux density for direct current of the stators thus formed by powder compression molding was 1.3 T for cold-molded members and 1.5 T for warm-molded members.

(Coil)

As the coil 18, a 6000-family material having a conductivity of 50% IACS specified in JIS H 4000 was used instead of a conventional copper-family material. As a coating material for the coil member, a polyimide resin was used.

(Stems)

As the first stem 15 and second stem 14, specimens made in the following manner were used. A powder in which 5 wt % of yttrium oxide and 2 wt % of aluminum oxide were wet-blended in ethanol into a commercial silicon nitride powder ($\alpha$-crystal phase ratio: 90% or over, average particle diameter: 0.8 $\mu$m) was dried. After a predetermined molding organic binder had been added, the mixture was molded. Sintering was carried out at 1800 degrees in a 4-atm nitrogen gas atmosphere for 10 hours, and it was worked into a predetermined shape with a diamond grindstone. For this sintered member and a sintered member manufactured simultaneously, the three-point bending strength was measured under JIS R 1601. The average strength was 1050 MPa.

(Housing)

The housing 8 was manufactured by the following method. A slurry was prepared by mixing 65 parts by weight of Ni powder containing 18% Fe and 8% Cr having an average diameter of 2.5 $\mu$m, 2 parts by weight of a dispersant, 11 parts by weight of water and 12 parts by weight of phenolic resin. The slurry was impregnated into a polyurethane foam which had a thickness of 8 mm and in which the number of cells per inch was 29, and excess slurry that adhered was removed by use of a metallic roll, and the sheet was dried for 10 minutes at 120° C. By heat-treating this sheet at 1200° C. under vacuum for one hour, a porous metallic member having a density of 0.91 g/cm$^3$ was prepared. After the metallic porous member has been worked into a cylindrical shape, it was set in a mold. By injecting under pressure of 1.2 MPa molten metal aluminum alloy (Al containing 2 wt % Cu) heated to 760° C., a housing comprising a metallic porous member/aluminum alloy composite material was manufactured. As a comparative member, a housing was also formed from only an aluminum alloy. The tensile strength measured for each of them was as follows: composite material: 231 MPa, aluminum alloy: 142 MPa.

(Return spring)

The return spring was manufactured by the following method. By repeatedly subjecting a steel comprising C=0.65 wt %, Si=1.98 wt %, Mn=0.78 wt %, Cr=0.75 wt %, V=0.11 wt %, the remainder being substantially Fe, to melt-forging, rolling, shaving, wire drawing, and heat treatment to obtain a wire 3.0 mm in diameter. Non-metallic inclusion were 20 μm at maximum. From this wire, a high-strength coil spring was manufactured by combining coiling, strain-removing annealing, shot peening and nitriding.

(Retainers)

For the retainers 13, 13' which retain the valve through a retaining part called cotter (retainer lock) and make a high-speed reciprocating motion with the valve 9, heat fatigue strength and shock strength are required. Also, they slide against the first return spring 2 and the second return spring 1, so that wear resistance is also required. To assure heat fatigue strength and shock strength, with an aluminum alloy, an alloy design for forming submicron fine crystal particles and a rapid-cool-solidifying process are required. As an aluminum alloy, using one containing Al-17 wt %, Si-1.52 wt %, Zr-1.5 wt %, Ni-2 wt %, Fe-5 wt %, Mn, an aluminum powder having an average particle diameter of 50 μm was manufactured by gas cooling solidifying process and it was used as a starting material. Also, in view of the requirement of wear resistance, because it was difficult to deal only with an aluminum alloy, as hard particles, 9 wt % of alumina particles having an average particle diameter of 2 μm and a maximum particle diameter of 12 μm were added.

After uniaxial powder compression molding, it was heated at 500° C. and densification and imparting final-shape were carried out simultaneously by hot forging. Thereafter, in order to remove burrs and surface layer portion where powder bonding was weak, barrel treatment was carried out. No machining was carried out. The density was 3.2 g/cm$^3$.

For conventional retainers, steels for machine structures such as JIS 17C or if circumstances require, alloy steels such as JIS 17C SCr415 are often used. The retainer as a comparative member was manufactured using the latter. After imparting shape to the latter alloy steel by hot forging, it was roughly machined, carburized and annealed and then finish worked. The density was 7.8 g/cm$^3$.

(Bolts)

As the bolts used to mount the housing 8 to the internal combustion engine body 19, a 4000-family material stipulated under JIS H 4000 was used instead of a conventional steel material.

(Valve)

5 wt % of yttrium oxide and 2 wt % of aluminum oxide were wet-blended into a commercial silicon nitride powder (α-crystal phase ratio: 90% or over, average particle diameter: 0.8 μm) in ethanol. The powder obtained was dried. After a predetermined organic molding binder had been added, the powder was molded into a valve. Thereafter sintering was carried out at 1800 degrees in a 4-atm-pressure nitrogen gas atmosphere for 10 hours, and it was worked into a specimen of predetermined shape by a diamond grindstone. For this sintered body and a sintered body manufactured simultaneously, the three-point bending strengths were measured under JIS R 1601. The average strength was 1050 MPa.

EXAMPLE 2

Coating films were formed on all of the surface or end face of the stem portion 16 of the valve 9, both end faces of the first return spring 2 or second return spring 1, end faces 28, 28' of the retainers 13, 13', surface or end face of the first stem 15, furface or end face of the second stem 14, or the surface of the armature 3 by the above-mentioned method. Using these parts, a valve-open-close mechanism was formed. Next, by actuating this valve-open-close mechanism, to what extent the power consumption decreased during driving compared with the case in which coating films were not provided at all was measured. The results are shown in Table 1.

[Results]

It was confirmed that the valve-open-close mechanisms obtained in Examples 1 and 2 could reduce the power consumption compared with a valve-open-close mechanism having parts not formed with a coating film.

EXAMPLE 3

Except that a diamond film, a chromium nitride film and a titanium nitride film were used as coating films instead of DLC films, an experiment was conducted in the same manner as in Examples 1 and 2. The results are shown in Table 2. The experiment was conducted with the film thicknesses set to about 1 μm.

[Results]

Even when a diamond film, a chromium nitride film and a titanium nitride film were used, as in the case when DLC films were used, it was confirmed that it was possible to reduce the power consumption compared with a valve-open-close mechanism comprising parts not formed with coating films.

EXAMPLE 4

Except that composite films in which powder particles of metallic compounds shown in Table 3 were dispersed in polymers shown in Table 3 were used instead of DLC films, an experiment was conducted in the same manner as in Example 2. The results are shown in Table 3. The experiment was conducted with the film thickness set to about 5 μm.

[Results]

Even when composite films were used, as in the case when DLC films were used, it was confirmed that it was possible to reduce the power consumption compared with a valve-open-close mechanism comprising parts not formed with coating films.

Since a coating film is provided on at least one of the parts, it is possible to reduce frictional resistance of the valve-open-close mechanism and to reduce the power consumption.

TABLE 1

| | where coating film was provided | Reduction rate in power consumption (%) |
|---|---|---|
| EXAMPLE 1 | surface of stem 16 of valve 9 | 6 |
| | end face of stem 16 of valve 9 | 2 |
| | end faces of first return spring 2 | 5 |
| | end faces of second return spring 1 | 5 |
| | spring bearing surface 28 of retainer 13 | 5 |
| | spring bearing surface 28' of retainer 13' | 5 |
| | end face of first stem 15 | 2 |
| | surface of first stem 15 | 3 |

TABLE 1-continued

| | where coating film was provided | Reduction rate in power consumption (%) |
|---|---|---|
| | end face of second stem 14 | 2 |
| | surface of second stem 14 | 3 |
| | surface of armature 3 | 2 |
| EXAMPLE 2 | all of the abovesaid parts | 23 |

TABLE 2

| where coating film was provided | Reduction rate in power consumption (%) | | |
|---|---|---|---|
| | diamond | chromium nitride | titanium nitride |
| surface of stem 16 of valve 9 | 9 | 7 | 6 |
| end face of stem 16 of valve 9 | 3 | 1 | 2 |
| end faces of first return spring 2 | 8 | 4 | 5 |
| end faces of second return spring 1 | 8 | 4 | 5 |
| spring bearing surface 28 of retainer 13 | 7 | 5 | 4 |
| spring bearing surface 28' of retainer 13' | 7 | 5 | 4 |
| end face of first stem 15 | 3 | 1 | 2 |
| surface of first stem 15 | 5 | 3 | 3 |
| end face of second stem 14 | 3 | 1 | 2 |
| surface of second stem 14 | 5 | 3 | 3 |
| surface of armature 3 | 3 | 3 | 2 |
| all of the abovesaid parts | 35 | 21 | 21 |

TABLE 3

| Test No. | Polymer | Metal Compound | Reduction rate in power consumption (%) |
|---|---|---|---|
| 1 | polyamideimide | $MoS_2$ | 28 |
| 2 | polyamideimide | BN | 27 |
| 3 | polyamideimide | $CaF_2$ | 25 |
| 4 | polyamideimide | $Cr_2O_3$ | 25 |
| 5 | polyamideimide | $MoO_3$ | 26 |
| 6 | polyamideimide | $B_2O_3$ | 26 |
| 7 | polytetrafluoro ethylene | $MoS_2$ | 28 |
| 8 | polyimide | $MoS_2$ | 27 |
| 9 | polyphenylene sulfide | $MoS_2$ | 27 |
| 10 | diarylphthalate resin | $MoS_2$ | 28 |

What is claimed is:

1. An electromagnetic actuator comprising a pair of electromagnets each made up of a stator and a coil, a movable element comprising an armature and a first stem for transmitting the force that acts on said armature to an external load, characterized in that a coating film is formed on a surface or an end face of said first stem.

2. A valve-open-close mechanism for an internal combustion engine comprising the electromagnetic actuator as claimed in claim 1 and a valve actuated by the electromagnetic actuator for opening and closing intake or exhaust ports.

3. The valve-open-close mechanism for an internal combustion engine as claimed in claim 2 wherein said electromagnetic actuator comprises a pair of electromagnets each made up of a stator and a coil opposed to each other with a gap therebetween; an armature disposed in said gap so as to be reciprocable between said pair of electromagnets by driving said electromagnets; and a first stem for transmitting to external the movement of said armature from one electromagnet toward the other electromagnet, said electromagnetic actuator being housed in a housing fixedly mounted to an internal combustion engine body;

said armature being moved from said one electromagnet toward said other electromagnet, so that said first stem opens said valve by pushing said valve;

said electromagnetic actuator further comprising:

a first retainer provided on said valve for imparting a biasing force to said valve for a valve-closing operation, and a first return spring mounted between said first retainer and said internal combustion engine body;

a second stem provided at a surface of said armature on the side not coupled to said first stem; and a second retainer provided on said second stem, and a second return spring mounted between said second retainer and said housing for imparting a biasing force to urge said armature, a coating film being formed on at least one of the surface or end face of said stem portion of said valve, end faces of said first return spring or second return spring, spring bearing end faces of said retainers, surface or end face of said second stem, and the surface of said armature.

4. The valve-open-close mechanism for an internal combustion engine as claimed in claim 2 wherein said coating film is a carbon-family coating film, a ceramic coating film or a composite coating film.

5. The valve-open-close mechanism for an internal combustion engine as claimed in claim 4 wherein said carbon-family coating film is a diamond-like carbon film, a diamond film or a composite coating film.

* * * * *